United States Patent [19]

Bulso, Jr. et al.

[11] Patent Number: 4,627,265

[45] Date of Patent: Dec. 9, 1986

[54] DOUBLE ACTION CONVERSION SYSTEM

[75] Inventors: Joseph D. Bulso, Jr., Canton; James A. McClung, North Canton, both of Ohio

[73] Assignee: Redicon Corporation, Canton, Ohio

[21] Appl. No.: 764,716

[22] Filed: Aug. 12, 1985

[51] Int. Cl.[4] ..... B21D 22/00

[52] U.S. Cl. ..... 72/354; 72/356

[58] Field of Search ..... 413/12, 14; 198/625; 221/75; 72/354, 356, 352

[56] References Cited

U.S. PATENT DOCUMENTS

| | | | |
|---|---|---|---|
| 3,346,948 | 10/1967 | Henning | 413/14 |
| 3,366,086 | 1/1968 | Fraze | 413/14 |
| 3,380,282 | 4/1968 | Scaletta | 413/14 |
| 3,841,946 | 10/1974 | Carter | 198/625 |
| 3,902,347 | 9/1975 | Ridgway et al. | 72/336 |
| 4,019,452 | 4/1977 | Rouse | 113/114 |
| 4,089,205 | 5/1978 | Mizumoto et al. | 72/450 |
| 4,166,424 | 9/1979 | Hahn et al. | 113/114 |
| 4,272,980 | 6/1981 | Carrieri | 72/404 |
| 4,273,507 | 6/1981 | Herdzina et al. | 414/750 |
| 4,342,404 | 8/1982 | Baker | 221/10 |
| 4,391,560 | 7/1983 | Fardin | 414/107 |
| 4,438,840 | 3/1984 | Damen | 198/398 |

*Primary Examiner*—Leon Gilden

*Attorney, Agent, or Firm*—Reese Taylor

[57] ABSTRACT

A conversion system for converting plain container end pieces into easy-open end pieces in a single press includes multiple slides, all driven by the press and carried within the confines of the press frame but independently adjustable and controllable. At least one of the slides carries conversion tooling and the other carries tab forming tooling and is arranged adjacent the conversion tooling so that the tab strip may be fed into the conversion tooling for attachment of the tabs to the end pieces by the conversion tooling. High speed feed rolls having helical gripping grooves are also provided to feed plain end pieces to the conversion tooling for forming and for attachment of the tabs.

6 Claims, 8 Drawing Figures

DOUBLE ACTION CONVERSION SYSTEM

RELATED PATENT APPLICATIONS

Application of Joseph D. Bulso, Jr. et al filed Feb. 11, 1985 as Ser. No. 700,040 for Method and Apparatus for Controlling the Spacing Between a Metal Forming Punch and a Complemental Die.

BACKGROUND OF THE INVENTION

This invention relates, in general, to the "conversion" of plain container end pieces for two- or three-piece containers to ones with easy open, pull-tabs on them. The invention relates, in particular, to a conversion press of this general nature requiring reduced maintenance and having faster operational capabilities.

DESCRIPTION OF THE PRIOR ART

In the container industry, it is well known that beverage containers, as well as some containers for other products of the easy-open kind can be manufactured with so-called "pull-tabs" on one end piece or shell which enable the container to be opened without the utilization of any type of mechanical opener, such as a can opener.

In producing container end pieces of this general type, each end piece or shell is usually formed by a drawing and redrawing operation, while the tab is formed in a separate press. The end piece is then "converted" from what might be called a "plain" end into one having either a push-in or tear-away tab. The conversion press generally performs a number of operations at a number of stations, such as forming a dimple or bubble which ultimately is shaped into the rivet which secures the tab to the end piece, scoring the end piece so that, upon operation of the tab, the end piece will be perforated to form an access opening, and finally affixing the tab itself.

The conventional steps involved in formation of such an end piece are well known in the art, as can be seen from Hahn U.S. Pat. No. 4,166,424.

One of the difficulties encountered in the prior art is with the method of feeding the end pieces or can ends into the conversion press. This is generally done in the prior art by utilization of a belt which has the disadvantage of wear requiring frequent replacement which leads to considerable down time for the press.

Another prior art approach to the feeding problem is that shown in Hahn U.S. Pat. No. 4,166,424 wherein the transfer is accomplished by a transfer bar which reciprocates horizontally and which has the disadvantage that it has to move into and out of the press.

Other feed means can be seen in Damen U.S. Pat. No. 4,438,840 which shows a hopper and conveyor arrangement; Herdzina U.S. Pat. No. 4,273,507 showing opposed, laterally movable barrels with gripping fingers; Baker U.S. Pat. No. 4,342,404 which utilizes conventional conveyors to transfer shells; and Fardin U.S. Pat. No. 4,391,560 which shows parallel, spinning rods to assist in lid transfer and Rouse U.S. Pat. No. 4,019,452 showing a mechanical, reciprocating transfer bar.

Another disadvantage in the prior art is with the loading of the press itself. In most of the prior art, the press receives an unbalanced load. The tab die, or the die which forms the tabs, is set to the side of the conversion die and unbalances the press since both the tab die and the conversion die run off the same slide. Carrieri U.S. Pat. No. 4,272,980 discloses, in general terms, the problems encountered with eccentric press loading and a hydraulic system for counteracting the problem. Mizumoto U.S. Pat. No. 4,089,205 also illustrates the general type of transfer press involved here.

Still another problem encountered in the prior art is that thermal expansion of the press during operation creates a specific problem in maintaining proper tolerances. As previously noted, one of the steps in converting the plain end piece to the easy-open type is forming a score line the depth of which must be controlled very precisely. In the prior art, the press bottoms out on every cycle on the scoring stroke. The spacing is generally controlled by stop blocks which are employed to balance the load and to hold the appropriate tooling clearance for the score line. The difficulty is that as the press warms up, it expands on the order of 0.005 or 0.006 inches and, effectively, the lid must be struck considerably harder when the press is cold than when it warms up. There are some thermal expansion (heated oil) controls which can be employed, but even these create some problems since they involve relatively complicated arrangements.

The present invention is intended to resolve many of the aforenoted problems.

SUMMARY OF THE INVENTION

As already noted, essentially the object of the present invention is to provide a reduced maintenance conversion system which will be more efficient and cabable of higher speed operation.

To that end, one of the objects of the present invention is to provide a unique feed system which simply, accurately, and in a controlled fashion feeds the preformed plain end pieces into the press for conversion into easy-open end pieces. In accomplishing this object, Applicant has found that utilization of a worm feed, using parallel feed bars driven off the press, minimizes the wear and maintenance problems encountered with a belt feed system and also is capable of extremely fast feeding. It should be noted here that while reference has been made to can end pieces or lids, the feed apparatus disclosed has equal utility with any parts which have constant diameters.

Another object of the invention is to avoid an uneven loading problem with the press. As noted, in some instances the tabs have been formed in the same press which performs the conversion. However, the slide for the tab die is then usually carried outside the press connections and to the side of the conversion die slide. To that end, Applicant has found that by using a double acting press with all conversion other than scoring forming operations being done on the outer slide, with the scoring operation being done on the nner slide and with the tab die slide carried within the press connections, the balancing is greatly enhanced.

Another object of the invention is to avoid the difficulties encountered due to the thermal expansion problems previously mentioned which make it difficult to control the depth of the score line. This has been accomplished by avoiding and eliminating use of the usual stop blocks and the concept of having the press stop and bottom out on every stroke. Essentially this is accomplished by cushioning the score die either by pneumatic or hydraulic means so that the press itself does not have to bottom out, but the relationship between the punch and the die is accurately main tained without the need for any stop blocks. This makes it possible to accomplish the function of the press with a greatly reduced amount of tonnage.

Accordingly, production of an improved double action conversion system of the type just described becomes the principal object of this invention with other objects thereof become more apparent upon a reading of the following brief specification considered and interpreted in view of the accompanying drawings.

OF THE DRAWINGS

BRIEF DESCRIPTION OF THE PREFERRED EMBODIMENTS

Figure 1:
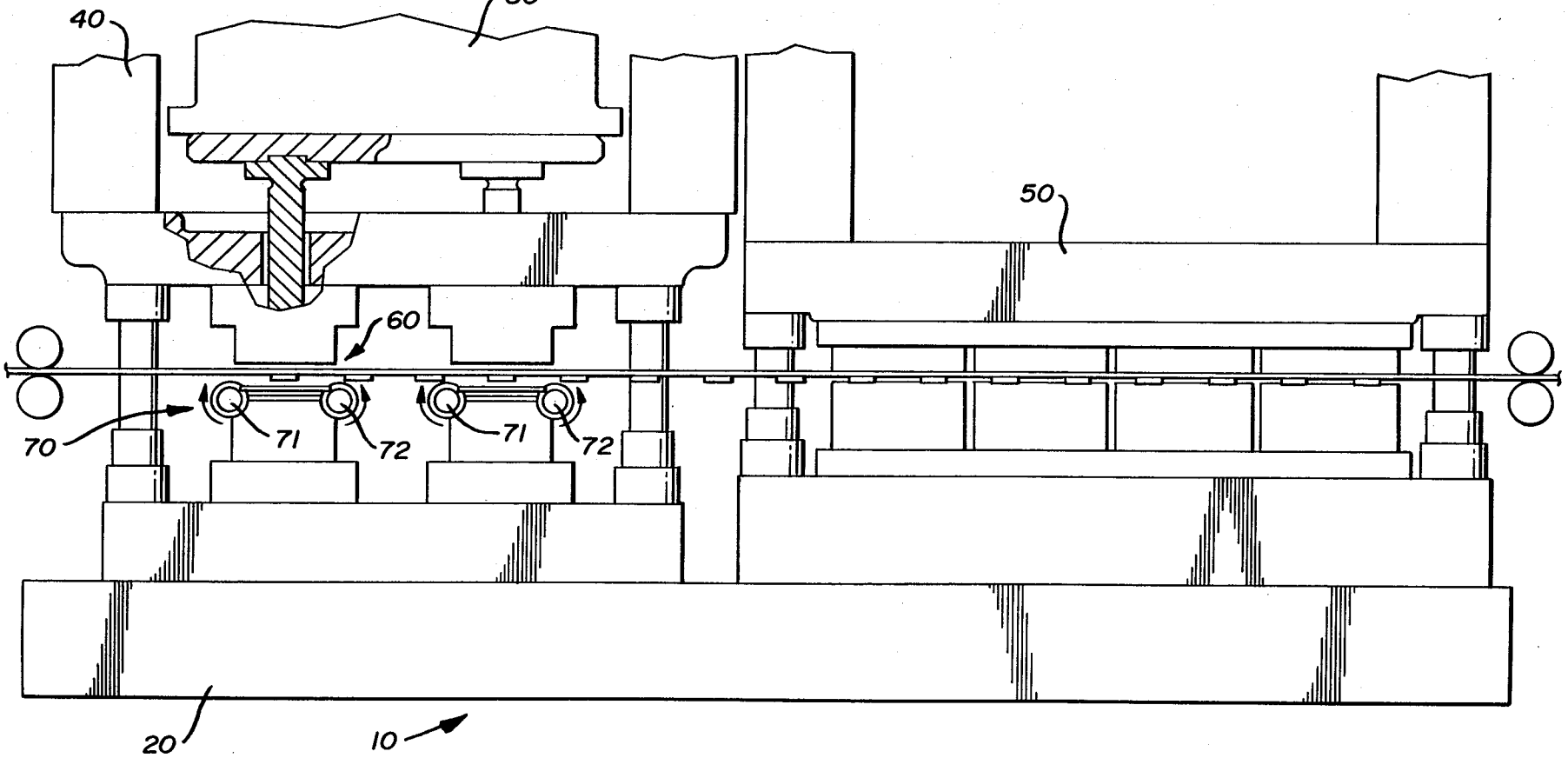
FIG. 1 is an expanded elevational, schematic view, partially in section, showing the press structure and arrangement.
Figure 5:
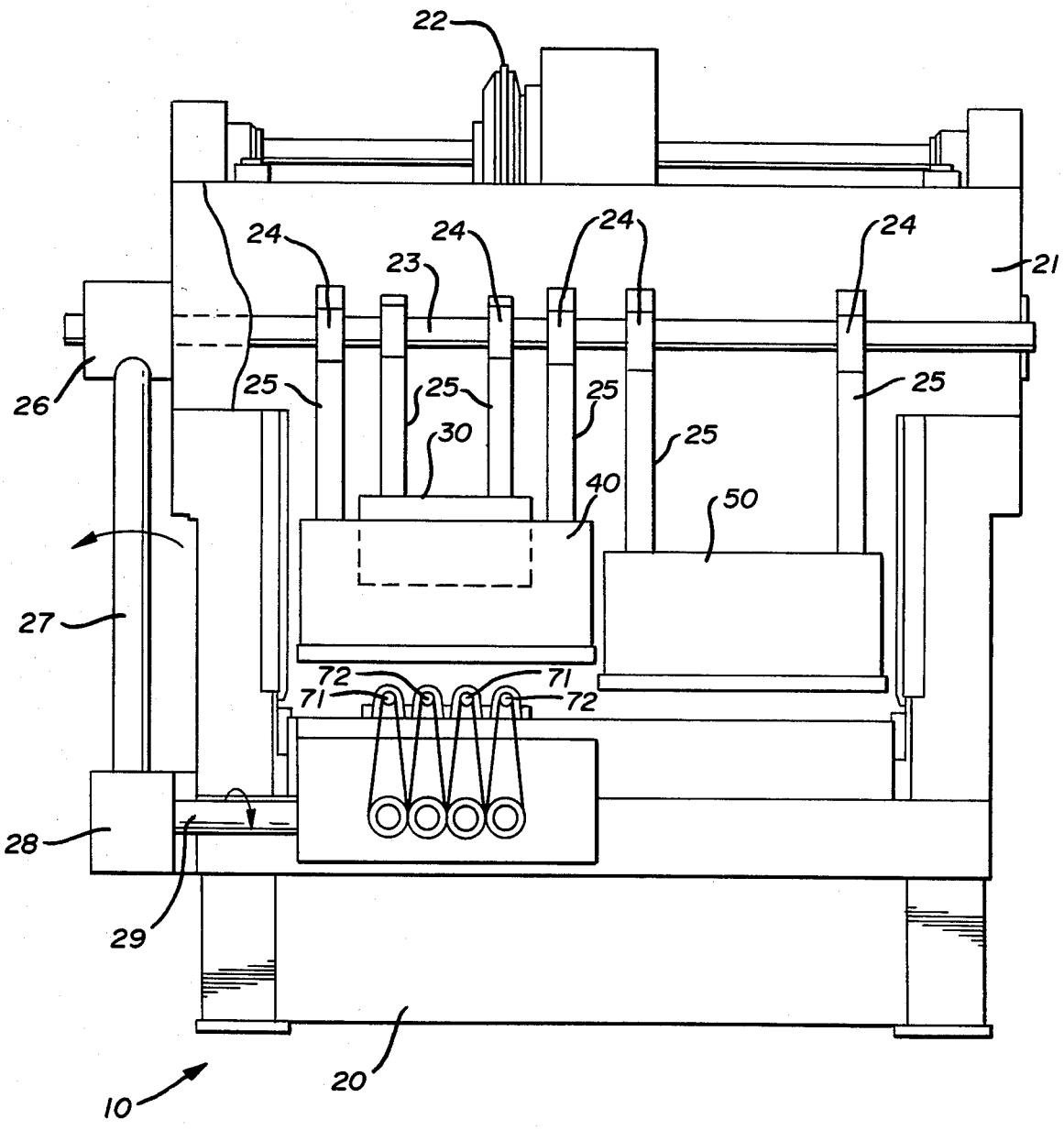
FIG. 5 is an elevational view of the press.

Referring first to FIGS. 1 and 5, it will be noted that the press, generally indicated by the numeral 10, includes a press bed 20, a head or crown 21, an inner slide 30, and an outer slide 40. A further third slide 50 which carries the tab die 51 is also illustrated in side by side relationship with slide 40 but within the press frame.

The press 10 has the usual flywheel 22 and crankshaft 23 which carries the throws 24,24 and connecting rods 25,25 associated with each of the appropriate slides 30, 40, and 50. This apparatus has not been illustrated in great detail since, in general, it is relatively well known to those skilled in the art. Ridgway U.S. Pat. No. 3,902,347 is representative of the patent prior art, may be referred to for additional information and is incorporated herein by reference for its teaching of the operation and adjustments of a double acting press.

It will be noted from FIG. 1 that the tab die carried by slide 50 and the conversion dies carried by slides 30 an 40 are arranged in side-by-side relationship. Effectively, separate slides and gibs for the tab die and for the conversion dies are both driven off the same crank 23 and operated in the same press within the frame of the press although their strokes are independently controllable and adjustable. However, a separate slide 50 is employed for the tab die which makes it possible to utilize a shorter stroke. For example, a one inch stroke may be needed for the tab die while a two inch stroke may be needed for the conversion die. By utilizing separate slides for the conversion and tab dies, the apparatus can be operated much faster while still accommodating the different stroke requirements.

This particular arrangement also solves one of the problems noted above and that is the need for balancing the press from side to side. By utilizing the separate slides and gibs for the tab and the conversion dies, this type of balancing arrangement is achieved since, even though different loads may be encountered in the conversion and tab forming operations, the slides operate independently of each other.

Normally, the ram of the press extends outwardly and supports the tab die. It is thus off center even though it is carried by the same press, and the result is off center loading of the press. By using a separate slide 50 for the tab die, the load is balanced since the loading for both the conversion die and the tab die are beneath the press support connections.

Still referring to FIG. 1, it will be noted that the score punch and die arrangement is illustrated schematically and referred to by the numeral 60. The feed mechanism is also illustrated somewhat schematically in this drawing and is indicated by the numeral 70.

Figure 2:
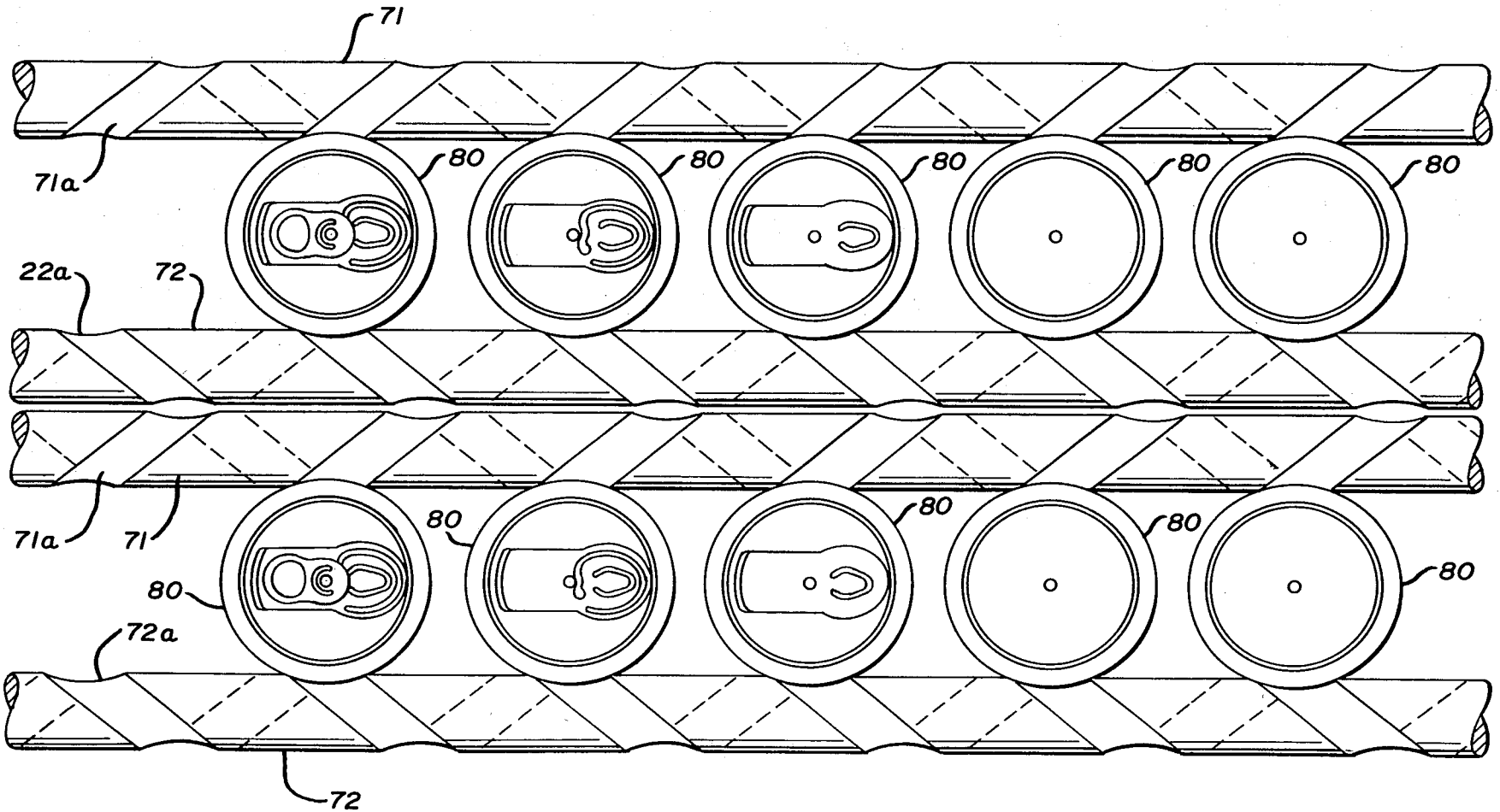
FIG. 2 is a partial plan view showing the worm feed mechanism for the end pieces.

Referring to FIG. 2, the feed mechanism 70 is illustrated in a plan view and it will be seen that it consists of parallely disposed feed rods 71 and 72 having helical gripping grooves 71*a* and 72*a* for the purpose of engaging at least a part of the periphery of ends 80. Use of this unique feed rod system also eliminates the wear problem common with belt feeds and permits faster operation.

Assuming that the path of movement of the ends into and through the press is from right to left of FIG. 2, it will be noted that the plain end 80 enters from the right and is engaged by the grooves 71*a*,72*a* of the feed bars 71 and 72 which rotate in opposite directions. It is then passed from station to station from right to left of FIG. 2 so that various operations illustrated in FIG. 2 can be performed at various stations. For example, in one station the dimple could be formed, in another the rivet could be formed from the dimple, at another the scoring could be accomplished and, finally, the tab could be applied.

With reference to FIG. 5, it will be noted that the feed bars are driven off the crank 23 by a series of right angle drives, gear boxes and shafts so that a 1:1 relationship is maintained with the press drive.

Referring again to FIG. 1, it will be seen that feed bars 71,72 feed the ends into press 10 at right angles to the feed path of the tabs which are fed from right to left of FIG. 1 after being formed by the tab die carried by slide 50.

It also should be noted in FIG. 2 that two sets of the feed bars are illustrated so that two container ends can be feed into the press simultaneously. More or less could be employed depending on the desired capacity of the press.

It will also be understood, as is knonw in the prior art, that the tab strip will be fed into the press adjacent the tab attachment station coming in at an angle normal to the longitudinal axis of the feed bars 71,72 and the axis of travel of the container ends. Thus the tabs, having been formed by the tooling carried by slide 50, will be indexed from right to left in FIGURE 1 as already noted.

Figure 3:
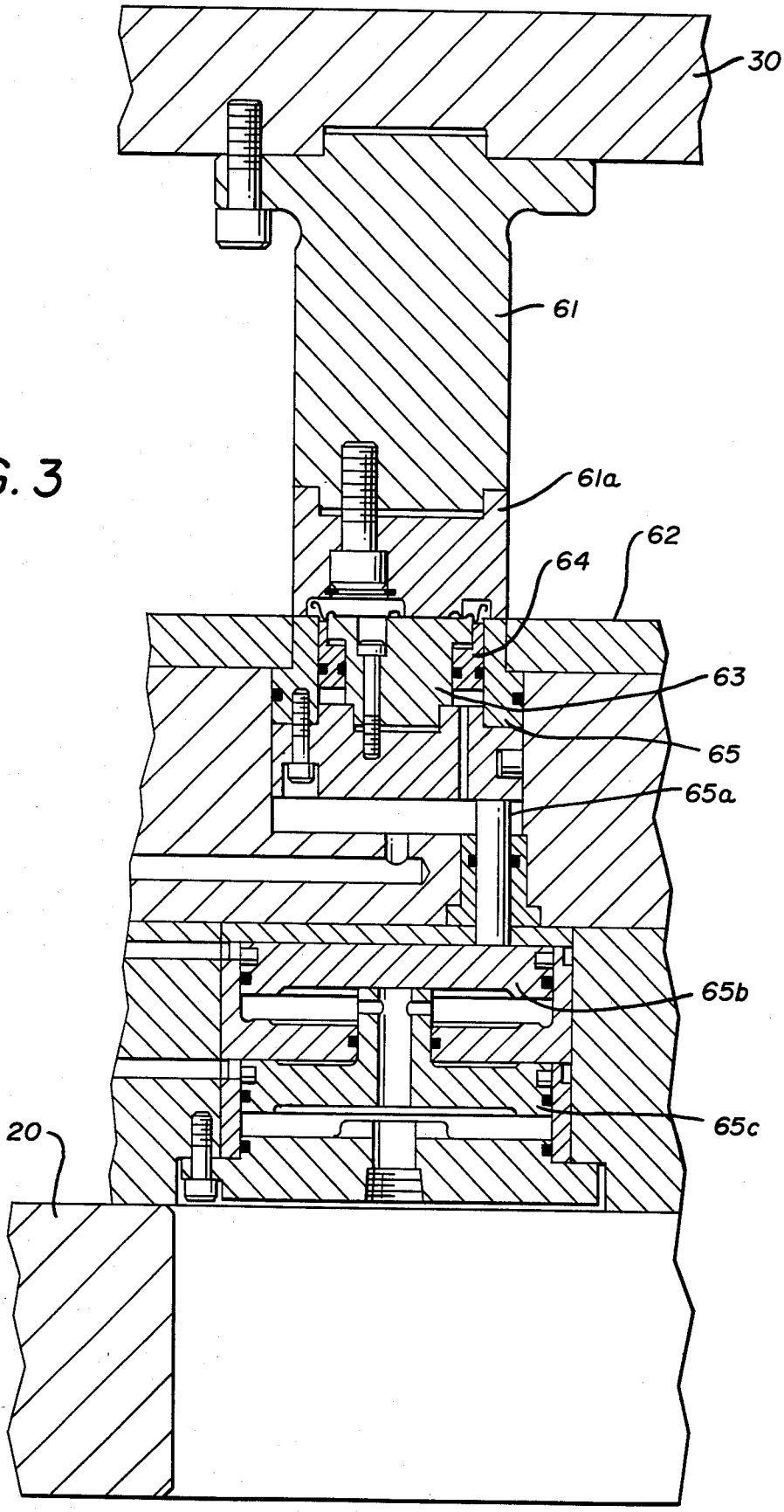
FIG. 3 is a partial sectional view showing the tooling apparatus for the score line forming station.
Figure 4:
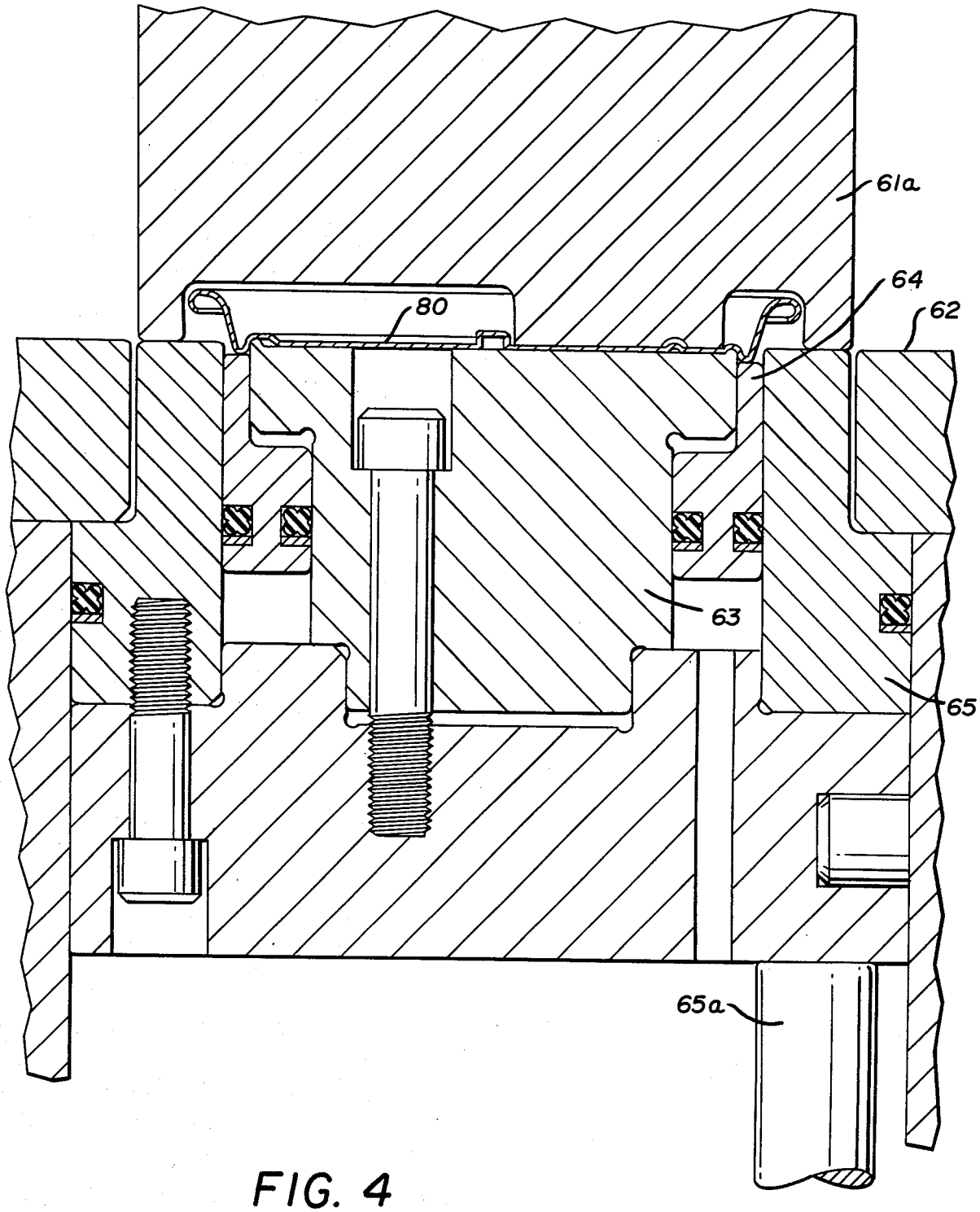
FIG. 4 is an enlarged sectional view, similar to FIG. 3.

Reference to FIGS. 3 and 4 illustrates the apparatus for accomplishing the score and controlling the gap or depth of score.

Specifically, this apparatus, which is generally indicated in FIG. 1 by the numeral 60, includes several components.

Figure 6:
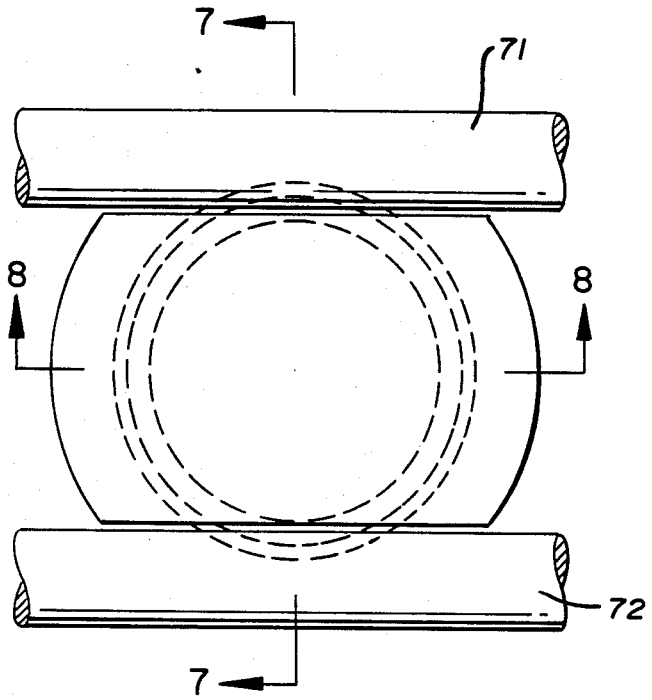
FIG. 6 is a partial plan view showing an end piece on the feed rolls and associated with the score line tooling.
Figure 7:
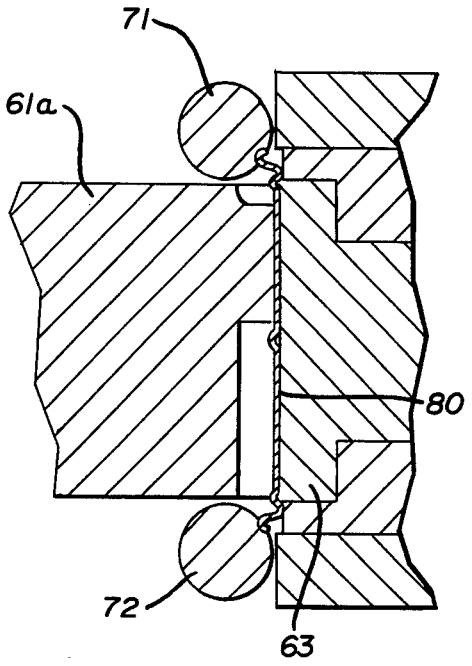
FIG. 7 is a sectional view taken along the line 7—7 of FIG. 6.
Figure 8:
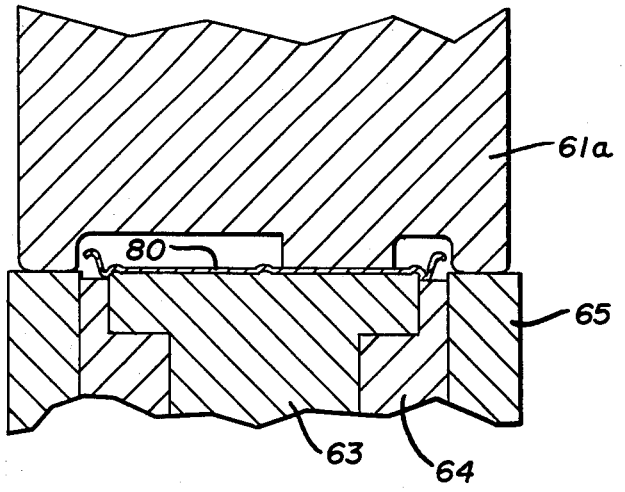
FIG. 8 is a sectional view taken along the line 8—8 of FIG. 6.

Thus, the die score station includes a punch riser 61 secured to the slide 30. A scoring punch 61*a* is secured to the distal end of the riser. This punch is in reality non-continuous in that it is designed so as to contact only a part of the lid so as to avoid interference with feed bars 71 and 72 as can be seen in FIGS. 6 through 8.

The press bed 20 receives a cover plate 62 and a forming die member 63.

Surrounding the forming die member 63 is a lift out piston 64 and surrounding that, in concentric relationship, is a support piston 65.

The support piston 65 is supported by a piston rod 65*a* which is, in turn, supported by the pistons 65*b* and 65*c* which may be either hydraulically or pneumatically actuated. Constant pressure is applied, however, through the rods 65*a* to the piston 65.

Effectively, this arrangement cushions the score die so that the press does not have to bottom on each stroke during the scoring operation. The relationship which is critical to maintaining the proper score, is the relationship or gap between the top of the piston 65 and the bottom of the score punch 61*a*. This relationship is maintained by the fact that the punch carries the pressure sleeve with it during a portion of its stroke.

Once the score has been made and the press reverses its travel, pneumatic pressure on pistons 64 through the passage 64*a* from a suitable source of pneumatic or hydraulic pressure, will lift the lid 80 back up to the die line for transfer to the next station by feed bars 71,72.

With respect to the discontinuous nature of the scoring punch 61*a* which enables it to effectively operate without interference with feed bars 71 and 72 reference is made to FIGS. 6 through 8.

Thus it will be seen in FIG. 7 that the score die does not have a circular cross section but has flat areas disposed in opposed relationship so that no interference is encountered when the scoring operation is performed as described with reference to FIGS. 3 and 4. The punch 61*a* engages the end piece 80 to impart the score line but dues not contact the bars 71,72.

While a full and complete description of the invention has been set forth in accordance with the dictates of the Patent Statutes, it should be understood that modifications can be resorted to without departing from the spirit hereof or the scope of the appended claims.

What is claimed is:

1. A high speed, double acting conversion press having a press frame and press crown for producing easy-open container end pieces from plain end pieces, comprising:

(A) a motor driver crank carried by the press crown;

(B) a press bed;

(C) a first, inner slide carried by said crank within the press frame for independently controlled, vertical, reciprocal movement toward said press bed;

(D) a second, outer slide carried by said crank within the press frame for independently controlled, vertical, reciprocal movement toward said press bed;

(E) end piece conversion tooling carried by said second, outer slide;

(F) metal scoring tooling carried by said first, inner slide;

(G) a third slide carried by said crank within the press frame for independently controlled, vertical, reciprocal movement toward said press bed and disposed in side-by-side relationship with said first and second slides;

(H) tab forming tooling carried by said third slide;

(I) first feed means for advancing container end pieces through the press; and (J) second feed means for advancing the tabs normally to the path of the end pieces.

2. The press of claim 1 wherein said first feed means include at least one pair of parallely disposed feed rods driven by said crank.

3. The press of claim 2 wherein said feed rods are rotatable about their longitudinal axes and contain helical gripping grooves; said scoring tooling including at least one scoring punch having a distal end dimensioned to pass between said rods.

4. A double acting conversion press having a press frame and press crown and crank for producing easy-open container ends, comprising:

(A) first and second, independently operated slides carried by the press within the press frame;

(B) end piece conversion and scoring tooling carried by said first and second slides; and (C) a third, independently operated slide (1) carried by the press and within the frame of the press, (2) disposed in side-by-side relationship with said first and second slides and controlled independently thereof and (3) carrying tab forming tooling.

5. The press of claim 4 wherein feed means are connected to the crank and disposed adjacent said first and second slides for passing end pieces into the press.

6. The press of claim 5 wherein said feed means include at least two elongate rotatable feed rods having helical gripping grooves said scoring tooling including at least one punch having a distal end dimensioned to pass between said rods.

* * * * *